US007901153B1

(12) United States Patent
Strider

(10) Patent No.: US 7,901,153 B1
(45) Date of Patent: Mar. 8, 2011

(54) DISPOSABLE TOOTHBRUSH APPARATUS

(75) Inventor: La Bron L. Strider, Los Angeles, CA (US)

(73) Assignee: L.L. Strider Development Corporation, Hawthorne, CA (US)

( * ) Notice: Subject to any disclaimer, the term of this patent is extended or adjusted under 35 U.S.C. 154(b) by 356 days.

(21) Appl. No.: 11/866,089

(22) Filed: Oct. 2, 2007

(51) Int. Cl.
*A46B 11/04* (2006.01)

(52) U.S. Cl. ..... 401/272; 401/275; 401/184; 401/186; 401/176

(58) Field of Classification Search ..... 401/44–47, 401/183, 184, 186, 137, 270, 274, 275, 282–284, 401/286, 289
See application file for complete search history.

(56) References Cited

U.S. PATENT DOCUMENTS 3,217,720 A * 11/1965 Cyzer ..... 401/45
3,356,095 A * 12/1967 Tylle ..... 401/132
4,865,481 A * 9/1989 Scales ..... 401/195
5,769,553 A * 6/1998 Chaudhri et al. ..... 401/173
5,893,378 A * 4/1999 Llerena ..... 401/268
6,648,641 B1 * 11/2003 Viltro et al. ..... 433/80
6,679,642 B1 * 1/2004 Dillingham et al. ..... 401/278
7,112,003 B2 * 9/2006 Frison ..... 401/272
7,124,894 B1 * 10/2006 Dobos ..... 206/581
7,311,456 B1 * 12/2007 Neal ..... 401/47

* cited by examiner

*Primary Examiner* — David J. Walczak
*Assistant Examiner* — Keegan Gumbs
(74) *Attorney, Agent, or Firm* — Venable LLP; Stefan J. Kirchanski; Deborah A. Feinblum

(57) ABSTRACT

A disposable toothbrush apparatus incorporates a dentifrice and at least one rinsing fluid within its hollow body. The apparatus includes a brush component having a series of bristles secured to it and an opening between the bristles that connects to an internal lumen within the apparatus containing the dentifrice for automatic dispensing thereof. The apparatus also includes a handle component with a hollow interior portion. The tapered upper end of the handle forms a coupling area adapted to fit within the lumen of the brush component. The hollow handle component contains compartments for rinsing fluid so that no external source of liquid is required to brush ones teeth.

11 Claims, 7 Drawing Sheets

DISPOSABLE TOOTHBRUSH APPARATUS

BACKGROUND OF THE INVENTION

1. Area of the Art

The present invention relates to devices and methods for cleaning the teeth and between the teeth and gums of a user and more particularly to a disposable toothbrush apparatus that provides all the elements required for a user to clean their teeth, even in the absence of water or other cleansing or rinsing medium.

2. Background Art

It has been well established that substantial health benefits are derived from regular dental care performed by an individual together with periodic examination and treatment by professionally trained dentists. Likewise, it is well recognized that regular brushing of the teeth, particularly after every meal, serves to dislodge food particles which become lodged in the contours of the teeth, gums and in between. If these food particles are allowed to remain, they can lead to tooth decay, gingivitis, and halitosis. Moreover, when properly performed, regular brushing also serves to maintain good circulation in gingival tissue, thereby lessening the likelihood of gingival disease, one of the prime causes of premature loss of teeth. Perhaps of less significance, but still important are the stain removal and brightening actions resulting from regular brushing, which contribute noticeably to the cosmetic/aesthetic appearance of the individual.

In many circumstances, however, such as when an individual is traveling, at work, or is out with friends, it may be difficult for the individual to maintain a regular regimen of dental care. For instance, it may be inconvenient for the individual to bring their toothbrush or toothpaste with them, or they may simply forget. Moreover, when a user is on the road and does not have access to facilities, such as running water, it may be impossible, inconvenient or unpleasant for the individual to engage in proper dental care.

Several inventions have attempted to address these limitations by providing single use or disposable toothbrushes. These disposable toothbrushes may make it easier to keep up a regular regimen of dental care because they may be freely available as amenities at hotels, or inexpensively purchased by the traveling individual. However these inventions fail to provide the other elements required for brushing one's teeth, namely toothpaste, or other cleansing agents, and a rinsing fluid such as water. While some inventions incorporate toothpaste, or other cleansing agents, within the toothbrush, these inventions still fail to provide another necessary component for proper oral cleaning, a rinsing fluid. As previously mentioned, the primary object of brushing one's teeth is to dislodge food particles from the teeth, gums, and spaces in between. Because prior art devices fail to provide a rinsing fluid, an individual without access to an appropriate rinsing fluid will not be able to properly rinse away dislodged particles. As a result, these particles may remain in the oral cavity and become re-affixed to the individual's teeth, gums, or in between, potentially leading to tooth decay, gingivitis, and/or halitosis.

Due to the aforementioned limitations of prior art dental cleaning devices and accessories, there is a desire in the art for a toothbrush apparatus that provides all elements required for proper dental care.

SUMMARY OF THE INVENTION

The present invention overcomes the limitations of prior art toothbrush devices and accessories by providing a disposable toothbrush apparatus that provides all of the elements required for proper dental care. To attain this functionality, the present invention teaches a novel disposable toothbrush apparatus, which incorporates a dentifrice, such as toothpaste, baking soda, hydrogen peroxide, triclosan, extracts from Salvadora persica, or other agents well known in the art and at least one rinsing fluid, such as water, hydrogen peroxide, fluoride rinse or mouthwash, within the body of the toothbrush apparatus.

In one embodiment, the toothbrush includes a brush component having a proximal end, a distal end, a top surface, a bottom surface, and an intermediate area in between. The top and bottom surface may have a planar rectangular configuration and may taper downward to the intermediate extent. A series of bristles are secured to, and extend upward from, the bottom surface of the brush part. The bottom surface of brush component also includes an opening at some point between the brush component's distal and proximal end that connects to an internal lumen within the intermediate area of brush component. The lumen can contain a dental cleansing agent, such as toothpaste, baking soda, or hydrogen peroxide.

The toothbrush also includes a handle component, which may be of a generally cylindrical or ellipsoidal shape. It has a proximal end, a distal end and an intermediate area in between. The handle component is typically constructed from a transparent, plastic material and has a hollow interior portion. Towards its proximal end, the generally cylindrical handle tapers down and terminates, at its proximal end, in a resilient tip, having a slit or other passageway. The tip may be constructed of rubber, or some other resilient material such as polyurethane, or foam. The tapered proximal end of the handle and the tip forms a coupling area, which is adapted to fit within the lumen of the brush component at the brush component's distal end. The brush component should be securely coupled to the handle component, such that the components do not become disconnected during use.

The hollow interior portion of the handle contains a rinsing fluid, such as water or mouthwash. Separate water and mouthwash compartments can be provided. When the handle component is coupled to the brush component of the toothbrush apparatus, the rinsing fluid may flow from the hollow interior of the handle, through the slit in the resilient tip, through the lumen of the brush component, and out the opening in the bottom surface of the brush component. In one embodiment, a portion of the handle component of the toothbrush is composed of a flexible material, such as rubber or polyurethane, such that when a user squeezes the flexible portion of the handle, the rinsing fluid is forced out of the opening in the brush component by the corresponding increase in pressure. The rinsing fluid is contained within the hollow interior space of the handle component by a seal that fits on the handle component's distal end. In one embodiment, this seal is permanently affixed to the handle component. In alternate embodiments, the seal can be removed such that the rinsing fluid can be refilled.

In another embodiment of the present invention, the handle component of the toothbrush apparatus can be divided into two interior hollow spaces. One space can contain one rinsing fluid, such as water or mouthwash, and the other hollow space may be filled with a different rinsing fluid. For example, a first interior hollow space may contain water to rinse an individual's mouth during brushing, and a separate second interior space can contain mouthwash, which a user can rinse with before or after brushing their teeth. The separate interior spaces of the handle component can be separated by a seal. In one embodiment, the handle component of the toothbrush apparatus is compose of two hollow handle elements with each handle element containing one of the two rinsing fluids. In this embodiment, the second handle element can be removed from the toothbrush apparatus, such that the user may later rinse with the contents of the second handle element without carrying the entire toothbrush apparatus with them.

In another embodiment of the present invention, a floss dispenser may be disposed on the proximal end of the handle component of the toothbrush apparatus. This improvement allows an individual to perform a complete and thorough dental cleaning with the inventive apparatus in the absence of the normal elements required for dental cleaning. Accordingly, an individual can keep up their dental cleaning regimen no matter their location, or the facilities available in that location.

In yet another embodiment an upper surface of the brush portion of the device bears a region of short bristles or ridges that act as a tongue cleaner or scrapper These and other advantages of the current invention, as well as the details of the invention's embodiments, will be more fully understood from the following detailed description and drawings, in which:

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a dental cleaning system incorporating dentifrice and rinsing solution.

Figure 1:
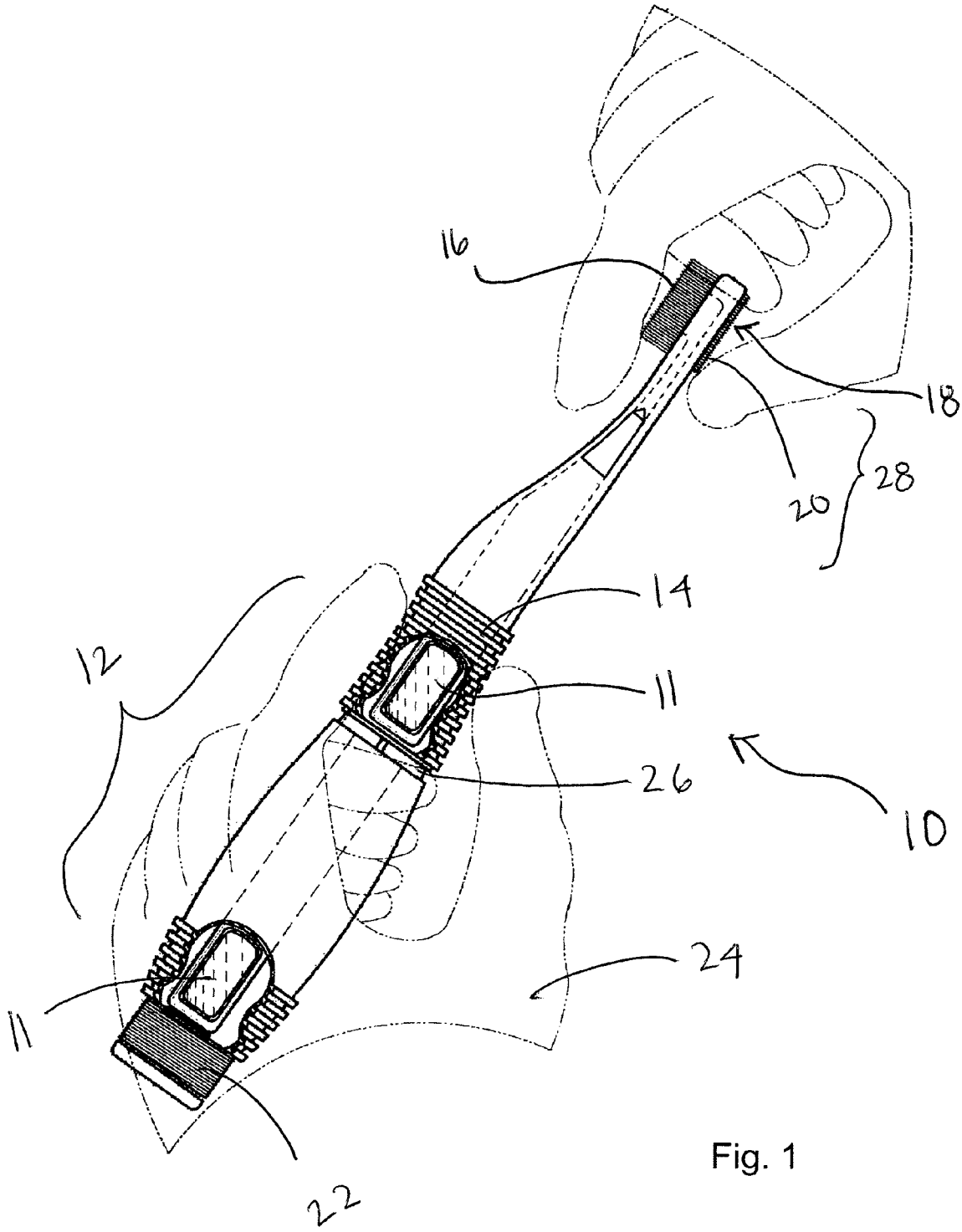
FIG. 1 is a perspective view of one embodiment of the inventive device.
Figure 2:
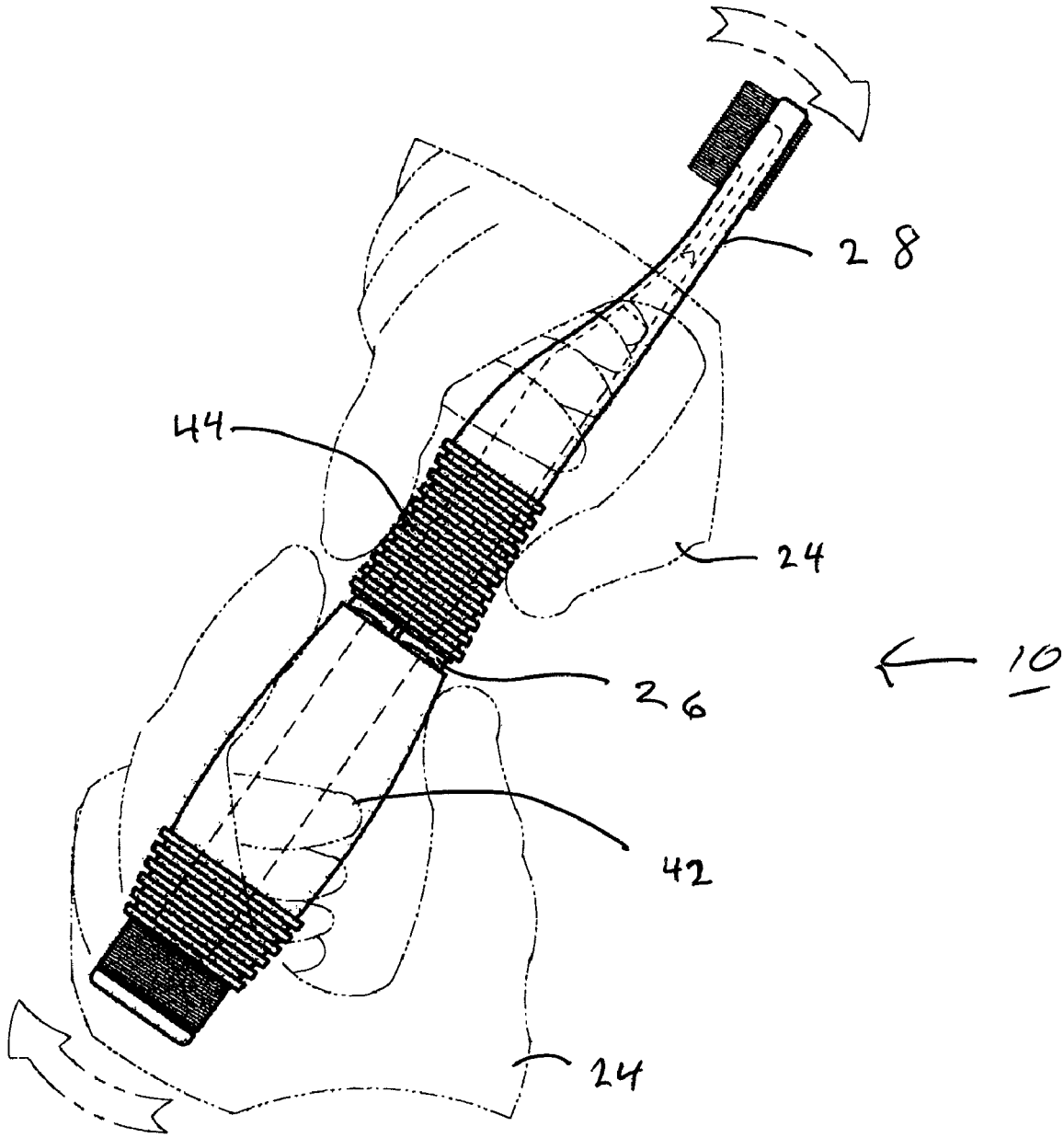
FIG. 2 is a perspective drawing showing the handle being disassembled to gain access to the internal fluid compartment.
Figure 3:
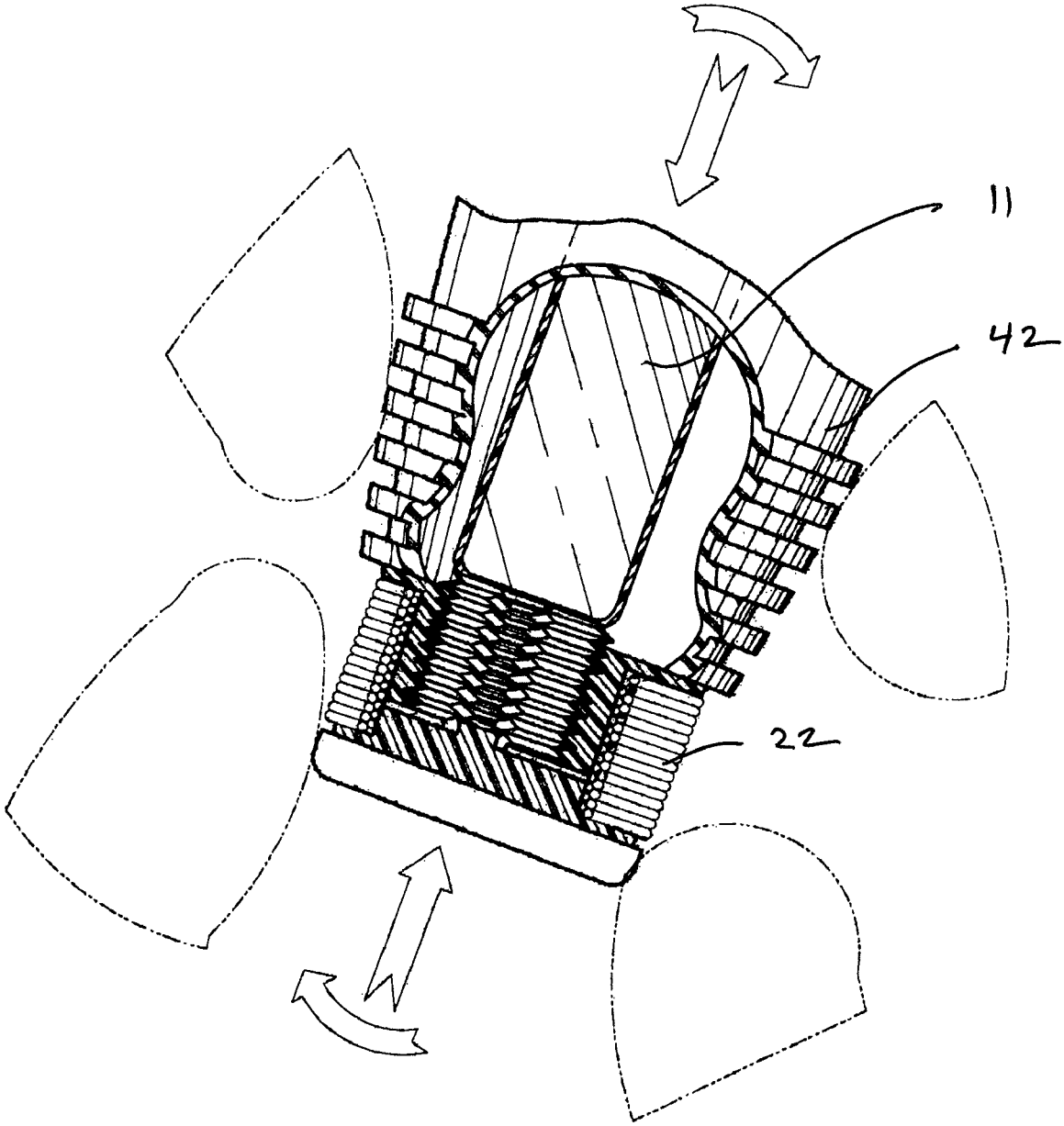
FIG. 3 is shows removing the floss spool to access an internal fluid compartment.

FIG. 1 shows a perspective view of one embodiment of the invention. The device 10 has a somewhat enlarged (compared to a common toothbrush) handle 12 that is ergonomically shaped to make it easy to grasp. Concentric ribs 14 are provided to improve the users grip. The distal end of the device tapers and bears a toothbrush 16 comprised of a plurality of bristles. Shorter bristles or projections 18 are borne by the back side of the tooth brush 16 to form a tongue scrapper 20. The proximal end of the device 10 bears a floss spool 22 which carries a length of dental floss. The handle 12 contains a variable number of fluid compartments 11. In the figure a first compartment 11 is shown in the distal (upper) portion 44 of the handle 12, and a second compartment 11 is shown at the proximal end of the lower portion 42 of the handle close to the floss spool 22. It is likely that the lower portion 42 of the handle 12 will also contain at least a second compartment 11 adjacent the mid-line 26. As indicated by the phantomed hands 24 in FIG. 2, the handle 12 can be separated at a mid-line 26 to access fluid compartments 11. As shown in FIG. 3 the lower fluid compartment 11 in the lower portion 42 of the handle can be accessed by unscrewing the floss spool 22.

Figure 4:
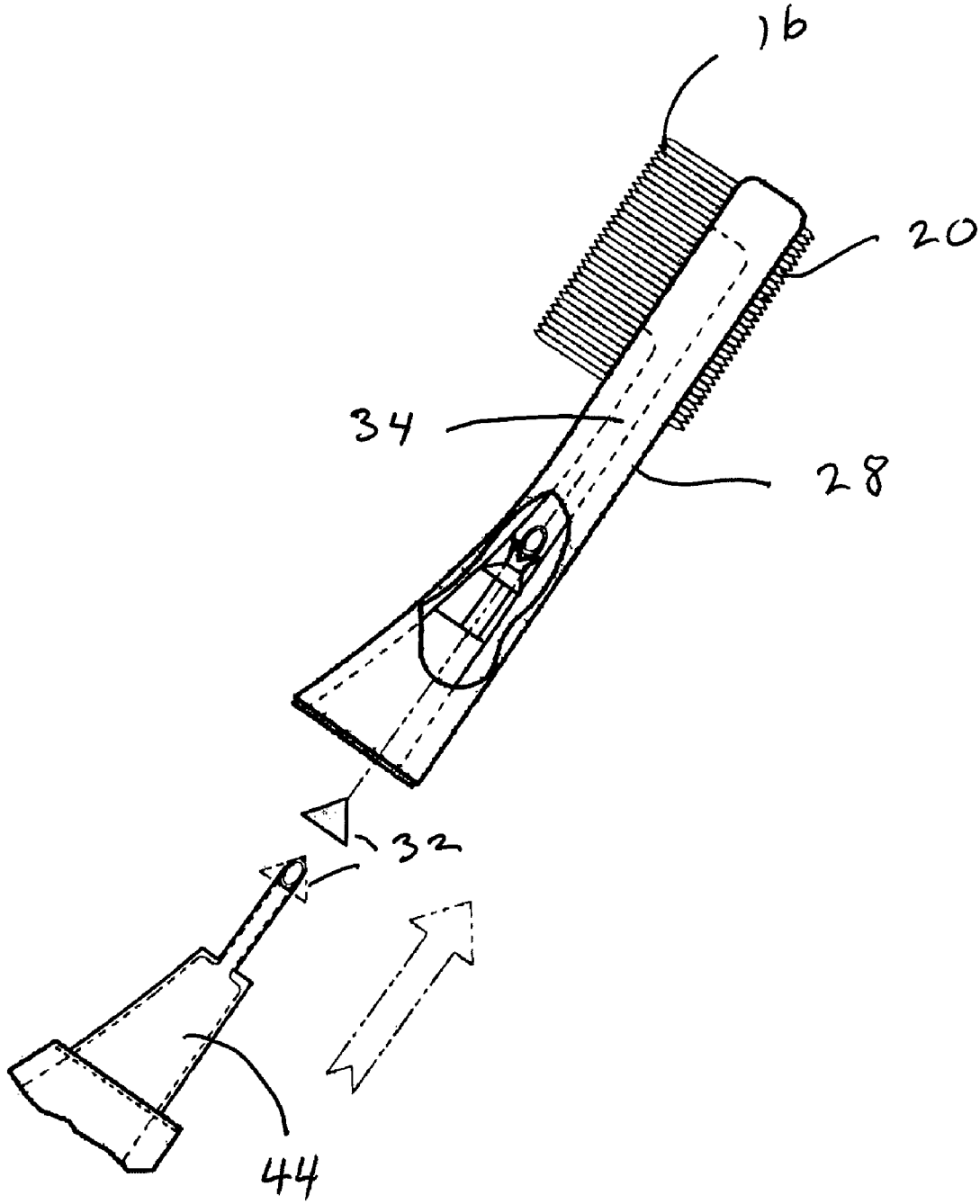
FIG. 4 shows a plunger device used to dispense dentifrice stored in the brush end of the device
Figure 5:
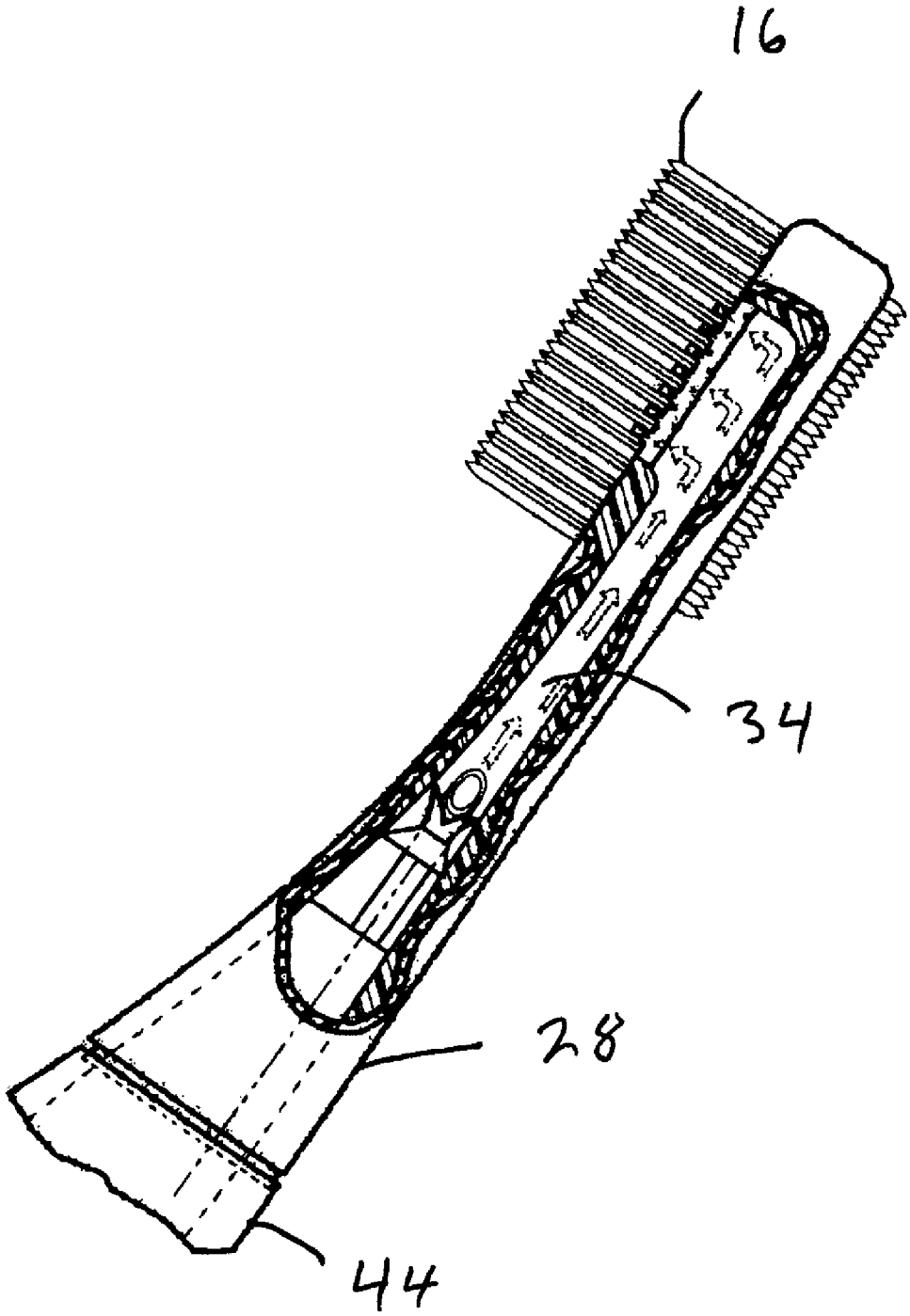
FIG. 5 shows dentifrice being released into the brush.
Figure 6:
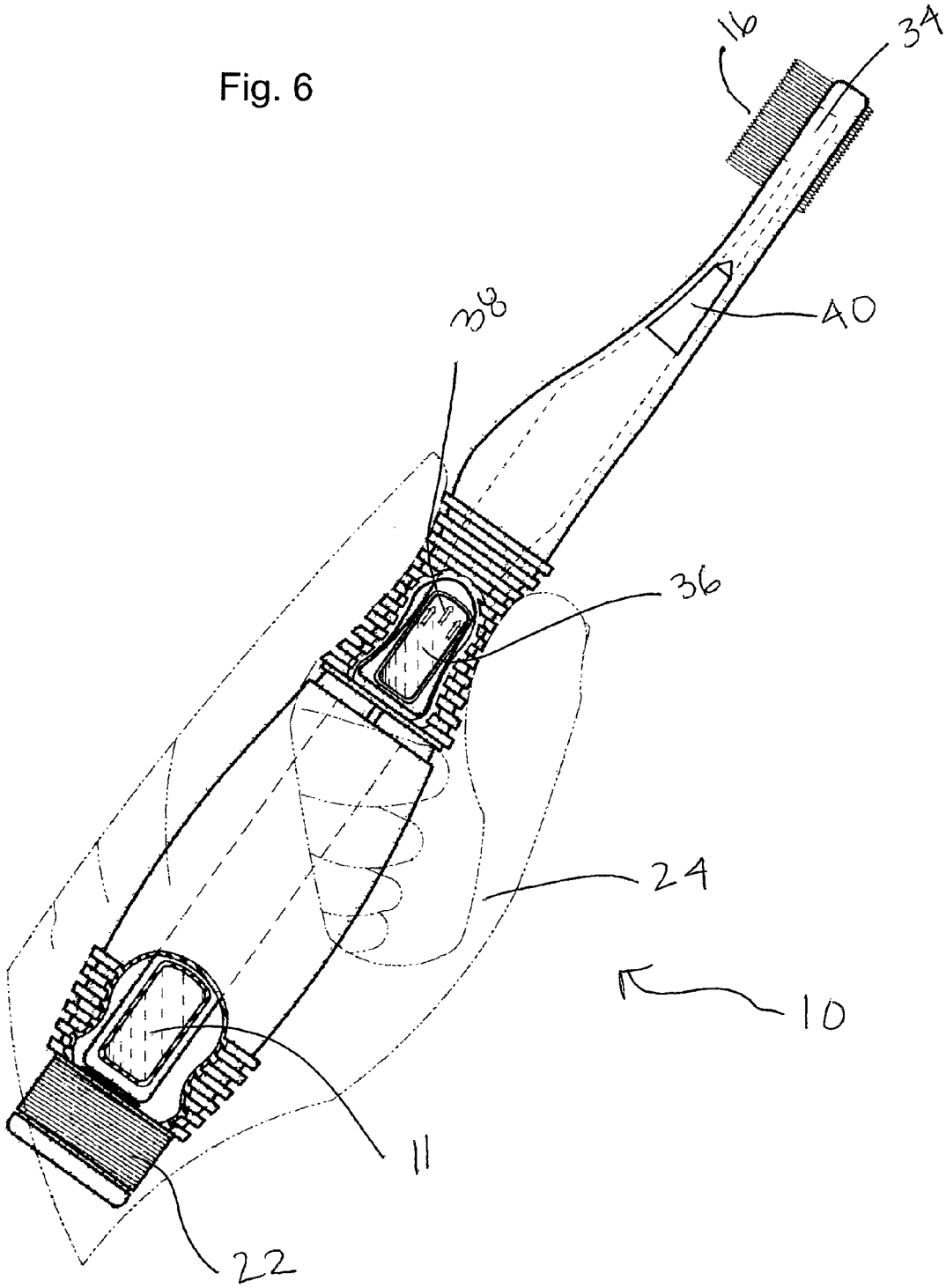
FIG. 6 shows an alternate embodiment where dentifrice and/or rinse are released from a middle region of the handle by squeezing.
Figure 7:
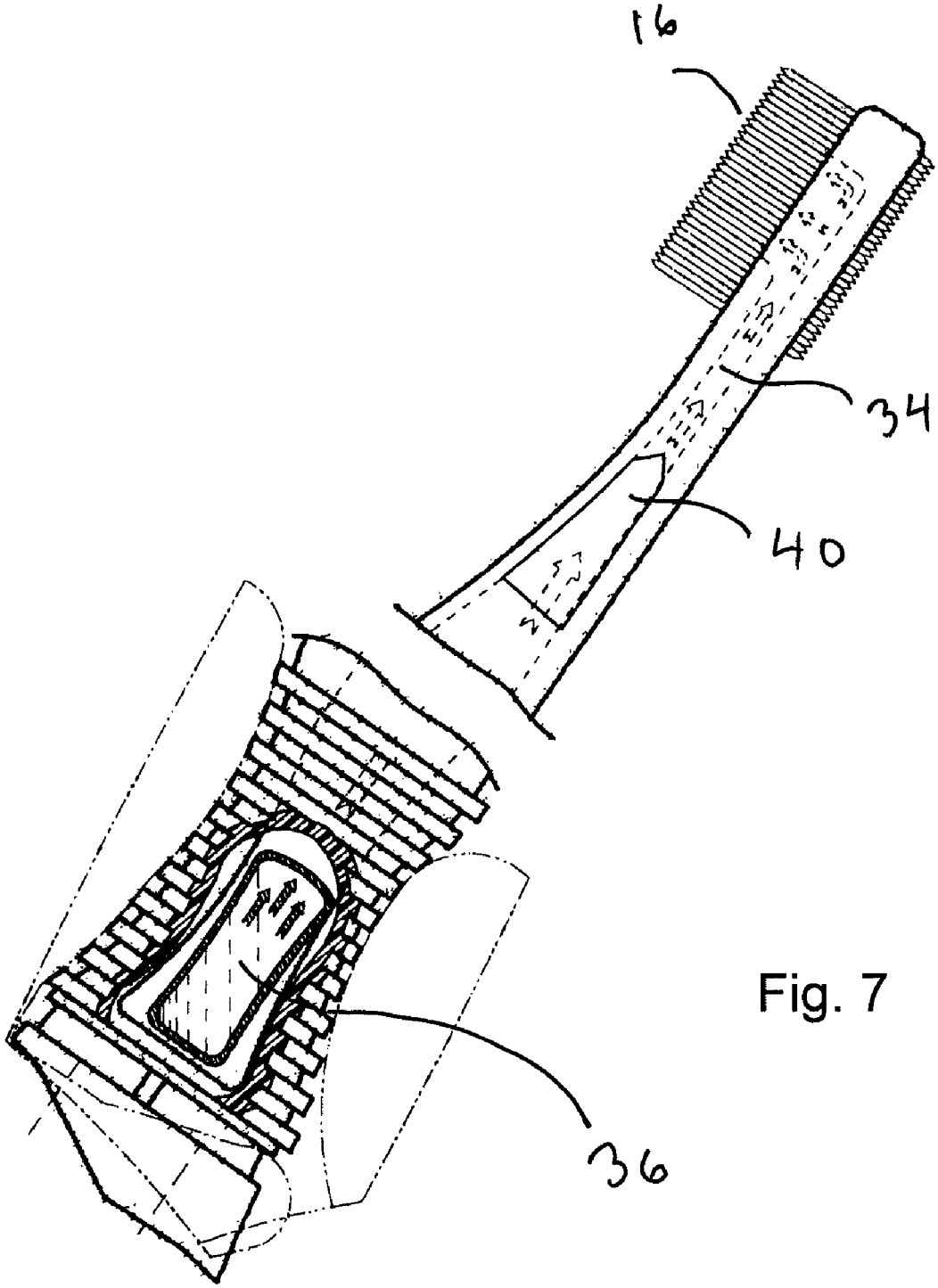
FIG. 7 is a close-up view of the embodiment of FIG. 6 with the dentifrice and/or rinse being squeezed through a one-way valve into the brush.

As shown in FIG. 4 the brush end 28 is separable from the handle and can pressed down over a plunger 32 so that dentifrice located within the brush end 28 is forced into a passage way 34 and through one or more orifices to be dispensed into the brush 16 (see FIG. 5). Alternatively, as shown in FIG. 6 rinse liquid and/or dentifrice is located in an integral compartment 36 and is dispensed into the brush 16 when the handle portion around the compartment 36 is squeezed (FIG. 7). The dentifrice and/or rinse are forced through a passageway 38 in the brush end 28 and through a one way seal 40 formed as a duckbill flap valve or the like. Thereafter, the dentifrice and/or rinse solution is dispensed through the bristles of the brush 16.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A disposable toothbrush apparatus, comprising:

a brush component having a plurality of bristles extending in a generally perpendicular direction, a brush end containing a dentifrice disposed within in communication with a passageway and aperture opening in proximity to the plurality of bristles; and a handle component composed of coupled upper and lower handle portions, wherein the handle portions each have fluid containing compartments, an upper handle portion fluid containing compartment in fluidic communication with the brush component and a lower handle portion fluid containing compartment not in fluidic communication with the brush component, respectively, so that when coupled with the plurality of bristles the upper handle portion is configured to dispense contents of the upper handle portion fluid containing compartment into the plurality of bristles.

2. The disposable toothbrush apparatus of claim 1, wherein the contains a dentifrice selected from the group consisting of toothpaste, baking soda, hydrogen peroxide, triclosan, extracts of *Salvadora persica* and combinations thereof.

3. The disposable toothbrush apparatus of claim 1, wherein a part of the upper handle portion is constructed of a flexible material.

4. The disposable toothbrush apparatus of claim 1, wherein flossing means are incorporated on the end of the lower handle portion.

5. The disposable toothbrush apparatus of claim 1, wherein a one-way valve is disposed within the passageway.

6. The disposable toothbrush apparatus of claim 1 wherein the fluid is an aqueous solution selected from the group consisting of water, mouthwash, hydrogen peroxide, fluoride rinse and combinations thereof.

7. A disposable toothbrush apparatus, comprising:

a brush component having a plurality of bristles extending in a generally perpendicular direction, a brush end containing a dentifrice disposed within in communication with a passageway and aperture opening in proximity to the plurality of bristles; and a handle component composed of coupled upper and lower handle portions, wherein the handle portions each have fluid containing compartments, an upper handle portion fluid containing compartment in fluidic communication with the brush component and a lower handle portion fluid containing compartment not in fluidic communication with the brush component, respectively, so that when coupled with the plurality of bristles the upper handle portion is configured to dispense contents of the upper handle portion fluid containing compartment into the plurality of bristles; and flossing means incorporated on the end of the lower handle portion.

8. The disposable toothbrush apparatus of claim 7 wherein a one-way valve is disposed within the passageway.

9. The disposable toothbrush apparatus of claim 7 wherein a part of the upper handle portion is constructed of a flexible material.

10. The disposable toothbrush apparatus of claim 7, wherein the brush end contains a dentifrice selected from the group consisting of toothpaste, baking soda, hydrogen peroxide, triclosan, extracts of *Salvadora persica* and combinations thereof.

11. The disposable toothbrush apparatus of claim 7 wherein the fluid is an aqueous solution selected from the group consisting of water, mouthwash, hydrogen peroxide, fluoride rinse and combinations thereof.

* * * * *